United States Patent [19]

Scheler et al.

[11] 4,317,875

[45] Mar. 2, 1982

[54] RECORDING MATERIAL CONTAINING DIAZO COMPOUNDS AND PROCESS FOR THE MANUFACTURE THEREOF

[75] Inventors: Siegfried Scheler; Klaus Thoese, both of Wiesbaden, Fed. Rep. of Germany

[73] Assignee: Hoechst Aktiengesellschaft, Fed. Rep. of Germany

[21] Appl. No.: 201,040

[22] Filed: Oct. 27, 1980

[30] Foreign Application Priority Data

Oct. 29, 1979 [DE] Fed. Rep. of Germany ..... 2943632

[51] Int. Cl.[3] ..... G03C 1/60; G03C 1/74; G03C 1/80

[52] U.S. Cl. ..... 430/8; 430/162; 430/168; 430/169; 430/512; 430/514; 430/517; 430/519; 430/533; 430/931

[58] Field of Search ..... 430/162, 8, 168, 169, 430/931, 512, 514, 517, 519, 533

[56] References Cited

U.S. PATENT DOCUMENTS 3,661,591 5/1972 Reed ..... 430/967
3,912,512 10/1975 Kumins ..... 430/157
4,080,208 3/1978 Bialczak ..... 430/8
4,225,659 9/1980 Drexler ..... 430/5

FOREIGN PATENT DOCUMENTS 1169227 10/1969 United Kingdom ..... 430/160

*Primary Examiner*—Charles L. Bowers, Jr.
*Attorney, Agent, or Firm*—James E. Bryan

[57] ABSTRACT

This invention relates to a recording material containing diazo compounds, in particular a microfilm, comprising a film base which is at least partially pervious to visible radiation, a light-sensitive layer and, on the reverse side of the film base, a filter layer which absorbs light in the long-wave ultraviolet spectral range and in the short-wave visible spectral range, wherein the filter layer is composed of a polymer which is insoluble or has been rendered insoluble by cross-linking, and of at least one yellow to orange-colored dye which is compatible with the constituents of the polymer and absorbs light in the range between about 360 nm and about 500 nm. The invention also relates to a process for the manufacture of a recording material.

6 Claims, No Drawings

RECORDING MATERIAL CONTAINING DIAZO COMPOUNDS AND PROCESS FOR THE MANUFACTURE THEREOF

The present invention relates to a recording material containing diazo compounds, in particular a microfilm, which comprises a film base which is at least partially pervious to visible radiation, a light-sensitive layer, and a filter layer which absorbs light in the long-wave ultraviolet spectral range and in the shortwave visible spectral range. The invention further relates to a process for the manufacture of the recording material.

Recording materials of the above-defined type gain more and more importance, due to their excellent properties. They are specially equipped to meet the requirements of different fields of application and have the definite advantage that they allow a considerable increase in the density of the information stored, for example, in archives, in industry and by administrative authorities.

As a rule, it is possible to prepare any number of additional copies from duplicates which have, for example, been printed from a silver film original. In many cases, this is a desirable and very useful characteristic, but if copies are, for example, made from a copyright original and are sold as reading or working copies only, reproducibility thereof represents a disadvantage. Reading copies for the micropublishing field should, therefore, be of such a nature that the production of further copies, so-called "pirated copies" is rendered impossible.

There are previous proposals for the manufacture of film materials with properties which render them safe against reproduction. A production of additional copies by transmission copying can, for example, be prevented with the aid of a light-scattering layer (German Auslegeschrift No. 1,915,210) or with the aid of a light-absorbing layer (German Pat. No. 671,641, German Offenlegungsschrift No. 2,344,089, and U.S. Pat. No. 4,080,208). It has been found, however, that the production of light-scattering layers entails great technical expenditure and that these layers will even then be operative only if they are applied in a relatively great thickness. Consequently, it is impossible to obtain the advantageous thin materials which are a prerequisite for a high density of information.

Light-absorbing substances are either incorporated into the film base or applied separately as an individual layer, the substances used being opaque in the sensitivity range of the known diazo compounds. It is, however, disadvantageous to include these substances in the film base during the manufacture thereof, because special process conditions must be adhered to for that purpose, which process is economical only if great quantities are produced. For example, when cleaning the extruder upon completion of production, undesirably great amounts of a more or less strongly dyed polyester mass are obtained as a waste product. If, on the other hand, light-absorbing substances are included in the light-sensitive layer, losses of resolution and contrast occur.

In principle, it is also possible to arrange the light-absorbing filter layer between the film base and the light-sensitive layer. Light-absorbing layers arranged in this way are, however, suitable only if they do not enhance the curling tendency of the film.

In addition, the light-absorbing substance must be prevented from diffusing into the light-sensitive layer.

It is also known to arrange light-absorbing filter layers on the reverse side of the film base, but these layers serve their purpose adequately only if they cannot be too easily removed by a mechanical treatment or by washing down with solvents so that the recording material can afterwards be used without difficulty as an original for copying.

Accordingly, it is an object of the present invention to provide recording materials containing diazo compounds, together with light-absorbing substances, which are not suitable for reproduction. The recording materials should be of such a nature that they do not allow a removal of the light-absorbing substances. It should, for example, be impossible to separate the light-absorbing substances from the film bases or the substances should be removable only by partially destroying the film bases and reducing the information recorded thereupon.

This object is achieved by a recording material containing diazo compounds, in particular a microfilm, which comprises a film base which is at least partially pervious to visible radiation, a light-sensitive layer, and a filter layer which absorbs light in the long-wave ultraviolet spectral range and in the short-wave visible spectral range and which is arranged on the reverse side of the film base. The filter layer comprises a polymer which is insoluble or has been rendered insoluble by cross-linking and at least one dye which is compatible with the constituents of the polymer and absorbs light in the range from about 360 nm to about 500 nm. The filter layer preferably contains a dye which has a yellow to orange color shade.

A recording material containing diazo compounds is thus obtainable, which cannot be further copied, even after having been tampered with. The filter layer makes it possible moreover to incorporate further additions in the same operating step and thereby advantageously to influence the properties of the film in an economical manner.

Suitable film bases which at least partially transmit visible radiation are, for example, cellulose esters or polymers, interpolymers or copolymers which are processed from melts into transparent films, for example, polystyrene or polycarbonate. Films of polyethylene terephthalate or of copolymers or interpolymers thereof, which are mainly chosen for their optical and mechanical properties, have proved to be particularly advantageous.

The light-sensitive layers used have a composition which is based on diazo compounds. The preferred light-sensitive layers contain at least one diazonium compound as the light-sensitive substance and at least one coupling component.

The filter layer which absorbs light in the long-wave ultraviolet spectral range and in the short-wave visible spectral range comprises, as the insoluble polymer, modified terephthalic acid esters, for example, a copolyester of terephthalic acid containing bisoxyethyl bisphenol A, isophthalic acid, or neopentyl glycol. As the polymers which have been rendered insoluble by cross-linking those polymers may be used which have suitable functional groups. Cellulose esters together with a hardening agent, for example, urea-formaldehyde resins or melamine-formaldehyde resins, and a hardening accelerator, such as p-toluene sulfonic acid, may, for example, be employed.

The polymers which have been rendered insoluble by cross-linking also include polyamides, polyisocyanates, formaldehyde resins and suitable prepolymers.

The dye which is compatible with the constituents of the polymer has a yellow to orange color shade. In addition to exhibiting the required spectral characteristics such as an absorption in the range between about 360 nm and about 500 nm and a stability to light which is as high as possible, the dye must also be soluble in the lacquer solvent and it must be sufficiently heat-stable. It must not pass out or sublime from the filter layer by exudation before or after the copying procedure, nor be capable of being transferred to other film materials by pressing it against the surfaces thereof. In this respect, chemical compounds comprising the suitable dye and the polymer used are advantageous. If the filter layer is applied by coextrusion or from the melt, the dye must, similarly, not only have the required spectral characteristics, but also a good compatibility with the polymer at the high temperatures generally employed and its heat-stability must be such that its spectral characteristics are not changed by the extreme conditions to which it is subjected.

Suitable dyes are, for example, mono- and bis-azo dyes, such as Sudan yellow GGN (C.I. Solvent Yellow 56), as far as they meet the criteria required with respect to solubility, e.g., solubility in alcohols, ketones and/or ethers, and with respect to compatibility. A layer which is applied to the reverse side of the film may also contain the usual additions, such as finely-divided lubricants or customary antistatic agents. Thus, the filter layer of the invention meets further important technical requirements without the need for additional working steps.

In order to prevent that the color shade of an imprinted title strip is affected by the filter layer, it is necessary to leave a space for the future title strip and apply the filter layer to the remaining area of the film only.

The invention relates also to a process for the manufacture of the recording material containing diazo compounds, in particular a microfilm, which comprises a film base which is at least partially pervious to visible radiation, a light-sensitive layer, and a filter layer which absorbs light in the long-wave ultraviolet spectral range and in the short-wave visible spectral range. In the process, one surface of the film base is provided with the filter layer composed of a polymer which is insoluble or is to be rendered insoluble by cross-linking and of a dye which is compatible with the constituents of the polymer and absorbs light in the range between about 360 nm and about 500 nm. The light-sensitive layer is then arranged on the opposite surface of the film base. Preferably, an adhesion-promoting intermediate layer is used when applying the filter layer as lacquer solution containing the polymer which is to be rendered insoluble by cross-linking together with the dye; upon application, the filter layer is dried and subsequently hardened.

The recording material of the invention may be prepared by coextruding the film base and the filter layer or by melt-coating the stretched or unstretched film base. In the coextrusion procedure, the material of the film base and the dyed material of the filter layer are simultaneously forced through a multi-slot die and then united. This procedure is highly advantageous because, in most cases, it does not necessitate the use of an additional adhesion-promoting intermediate layer. If the filter layer is prepared by melt-coating, it is preferably applied to the stretched film base.

Compared with an incorporation of the dye into the polymer of the film base, the coextrusion or melt-coating processes have the advantage that the dye-containing melt can be separately prepared, for example, by way of a dye-masterbatch. It is thus possible to use polymers which melt more easily or mix better with the dye, but which, for reasons of mechanical stability, are less suitable for the manufacture of film-base materials. Because the filter layer is very thin, relative to the total film thickness, the dye can be worked in more economically than in the case of dyeing the film base. In addition, temperature/time ratios can be chosen for the thin melt layers, which are adapted to the liability to decomposition of the dyes.

As already mentioned, an intermediate anchoring layer, for example as described in German Auslegeschrift No. 1,694,534, must be applied if the film base is coated with a dyed lacquer. Upon application of the lacquer solution, the material is dried, and the filter layer is then inseparably united with the correspondingly coated surface of the film base by means of a heat treatment. Due to the cross-linked structure, the filter layer is additionally less sensitive to scratching. The dry-layer weight usually ranges between about 5 and 20 $g/m^2$.

If the light-absorbing filter layers are used in the form of lacquers, they can be applied by printing, casting or other known processes. After evaporation of the solvent, care must be taken that the filter layer is sufficiently hardened by heating, exposing to ultraviolet light or similar measures.

Dyes which have a lower heat-stability are preferably employed in a hardened filter layer which, if necessary, advantageously can be printed even with colored title strips. While the printing of non-hardened filter layers may entail difficulties, caused by a partial or complete dissolution of the lacquer layer by the solvent contained in the printing ink, the printing of hardened filter layers is considerably easier and does not involve technical inconveniences. The choice of a suitable basic printing system is less critical than in the case of non-hardened lacquer layers.

The following examples explain the invention in more detail.

EXAMPLE 1

A 125 μm thick clear film of polyethylene terephthalate which is provided with an anchoring layer on both sides is coated on one side with yellow-dyed clear lacquers, with the aid of a coating knife having a width of 10 cm and a slot opening of 0.15 mm. The yellow lacquer layers are each dried for 3 minutes at 100° C. and are then additionally hardened by heating for up to 5 minutes. During the drying and hardening stage, the coated film samples lie on an aluminum plate serving as a plane support. The dry-layer weights are about 7 $g/m^2$.

The base lacquer employed is a 7 percent by weight concentration solution of cellulose acetopropionate in a solvent mixture composed of acetone, methanol, n-butanol and ethylene glycol monomethyl ether.

12.5 g of Sudan yellow GGN (C.I. Solvent Yellow 56) are dissolved in 1000 g of this lacquer solution and the yellow-dyed lacquer is used to prepare a non-cross-linked yellow film sample A which serves as a comparative sample.

The cross-linkable yellow-dyed lacquer is obtained from the non-cross-linkable lacquer by adding such a quantity of hexamethoxymethyl-melamine that the resulting weight ratio of cellulose ester/melamine resin is 9:1. As a hardening accelerator, p-toluene sulfonic acid is employed. From this cross-linkable yellow lacquer a yellow film sample B is prepared.

The cellulose acetopropionate herein used contains 3.6 percent of acetyl groups, 44.7 percent of propionyl groups and 1.8 percent of hydroxyl groups and it has, as a 20 percent by weight concentration solution in acetone/ethanol (72:8), a viscosity ranging from 53 to 91 poises.

The reverse sides of yellow film samples A and B are coated with a light-sensitive solution by means of a coating knife of 10 cm width and 0.15 mm slot opening. This light-sensitive solution has the following composition:

| | |
|---|---|
| 100 ml | of base lacquer, |
| 150 mg | of 5-sulfosalicylic acid, |
| 400 mg | of 2-hydroxy-3-naphthoic acid-N(2-methylphenyl)-amide, |
| 150 mg | of zinc chloride and |
| 500 mg | of 2,5-di-n-butoxy-4-morpholinobenzene diazonium fluoroborate. |

After drying again for 1 to 2 minutes at 110° C., light-sensitive yellow film samples A1 and B1 are obtained. The dry layer weight of the light-sensitive layer ranges between about 6 and 7 g/m$^2$.

To prepare the first diazo film generations, the light-sensitive layers of yellow film samples A1 and B1 are exposed in contact with a transparent silver film original, as is usual in diazoprinting, and the latent diazo film copies are then developed in a moist ammonia atmosphere. Exposure and development are carried out in a customary "diazomicrofilm duplicator". The dichromatic copies obtained from the original are rich in contrast and show a blue dye-image on one side of the film and an orange-yellow image background on the opposite side of the film. Viewed by transmitted light, the image portions of the copies appear black and the image background orange-yellow. Diazo film copies A1 and B1 cannot be used to prepare second diazo film generations A2 and B2, because a differentiation between the image and non-image areas is no longer possible. Diazo film copies A1 and B1 are consequently non-reproducible.

In order to verify the technical improvement achieved by the cross-linked yellow filter layer, in comparison with a film material carrying a conventional non-cross-linked soluble yellow filter layer, it is attempted to remove the filter layers from diazo film copies A1 and B1 with the aid of customary solvents, without destroying the image layer on the opposite side of the film and without damaging the film itself in the procedure. Diazo film copies A1 and B1 treated in this manner should afterwards enable a production of second diazo film generations.

The non-cross-linked yellow filter layer of diazo film copy A1 can be removed within a few seconds using a cotton pad, for example, soaked with acetone. Subsequently, the image portions of diazo film copy A1 which are on the opposite side of the film are again reproducible. By removing the yellow filter layer it has thus become possible to produce a second diazo film generation A2.

If the cross-linked yellow filter layer of diazo film copy B1 is treated in the same way, it is clearly less attacked during the same period of time. Producing a second diazo film generation B2 from diazo film copy B1 will, therefore, entail a considerable loss of information. It is, as a result, virtually impossible to utilize diazo film copy B2 in practice.

The comparative test shows that by employing a hardened yellow filter layer the safety of a non-reproducible microfilm is highly increased, even if an aggressive solvent, such as acetone, is used with the intention to remove the filter layer.

EXAMPLE 2

A diazo film copy C1 is prepared as described in Example 1, with the exception that the same quantity by weight of a butylated urea-formaldehyde resin is used as the cross-linking component for the cellulose acetopropionate. The urea resin employed is a conventional product having an acid number of less than 3. A 65 percent by weight concentration solution of this resin is isobutanol has, at 20° C., a viscosity ranging between 1000 and 1200 cP.

Also in this case, the resistance to solvents of the cross-linked yellow filter layer of diazo film copy C1 is compared with the solvent resistance of the non-cross-linked yellow filter layer of diazo film copy A1 of Example 1. The solvent used in this test is a mixture composed of 80 parts by weight of isopropanol and 20 parts by weight of water. After the solvent treatment, a reproduction test is carried out.

As in Example 1, the cross-linked yellow filter layer of diazo film copy C1 proves to be superior to the non-cross-linked filter layer of diazo film copy A1, in the solvent treatment and also in the ensuing duplicating test. While A1 shows the known results, C1 can be copied only with a marked loss of information. The preparation of a second diazo film generation C2 is rendered considerably more difficult.

EXAMPLE 3

The procedure of Example 1 is repeated, but this time dimethyl yellow (C.I. Solvent Yellow 2) is used as the dye for the yellow filter layer. To prepare the yellow-dyed absorbing filter layer, 8.75 g of dimethyl yellow are dissolved in 700 g of base lacquer.

In a test, the non-cross-linked yellow filter layer of a diazo film copy D1 is compared with the cross-linked filter layer of a diazo film copy E1, in terms of solvent resistance and reproducibility. As described in Example 2, the solvent employed is a mixture of 80 parts by weight of isopropanol and 20 parts by weight of water.

Within the same period of time, it is easier to remove the non-cross-linked yellow filter layer of diazo film copy D1 than the cross-linked filter layer E1. Reproducibility of the solvent-treated diazo film copy E1 is poorer than that of D1. The preparation of a second diazo film generation E2 is clearly more difficult than the preparation of a second generation D2.

It will be obvious to those skilled in the art thay many modifications may be made within the scope of the present invention without departing from the spirit thereof, and the invention includes all such modifications.

What is claimed is:

1. A recording material which is not suitable for the production of additional copies, containing diazo compounds, in particular a microfilm comprising a film base which is at least partially pervious to visible radiation, a light-sensitive layer of an ammonia developable two component diazotype formulation of an acid-stabilized diazonium compound and a coupler component, and, on the reverse side of the film base, a filter layer which is composed of a polymer which is insoluble or of a polymer which has been rendered insoluble by cross-linking on an adhesive promoting intermediate layer, and of at least one yellow-to orange-colored dye which is compatible with the constituents of the polymer and absorbs light in the range between about 360 nm and about 500 nm.

2. A recording material as claimed in claim 1 wherein the filter layer contains at least one mono- and/or bis-azo dye.

3. A recording material as claimed in claim 2 wherein the filter layer contains Sudan yellow GGN (C.I. Solvent Yellow 56).

4. A recording material as claimed in claim 1 wherein the filter layer contains a copolymer of terephthalic acid as the insoluble polymer.

5. A recording material as claimed in claim 1 wherein the filter layer contains a cellulose ester as the polymer which has been rendered insoluble by cross-linking.

6. A process for the manufacture of a recording material which is not suitable for the production of additional copies containing diazo compounds, in particular a microfilm, comprising a film base which is at least partially pervious to visible radiation, a light-sensitive layer of an ammonia developable two component diazotype formulation of an acid-stabilized diazonium compound and a coupler component, and a filter layer which absorbs light in the long-wave ultraviolet spectral range and in the short-wave visible spectral range, which comprises applying the filter layer, which is composed of a polymer which is insoluble or of a polymer which is to be rendered insoluble by cross-linking and of at least one dye which is compatible with the constituents of the polymer and absorbs light in the range between about 360 nm and about 500 nm, to one side of the film base, employing an adhesion-promoting intermediate layer when applying the filter layer as a lacquer solution, the filter layer being dried and subsequently hardened, and then arranging the light-sensitive layer on the opposite side of the film base.

* * * * *